US006346313B1

(12) United States Patent
Cook

(10) Patent No.: US 6,346,313 B1
(45) Date of Patent: Feb. 12, 2002

(54) TRANSFER FILM

(75) Inventor: Colin John Cook, Basildon (GB)

(73) Assignee: Hunt Graphics Europe Limited, Essex (GB)

( * ) Notice: Subject to any disclaimer, the term of this patent is extended or adjusted under 35 U.S.C. 154(b) by 0 days.

(21) Appl. No.: 09/367,417

(22) PCT Filed: Feb. 16, 1998

(86) PCT No.: PCT/GB98/00481

§ 371 Date: Oct. 19, 1999

§ 102(e) Date: Oct. 19, 1999

(87) PCT Pub. No.: WO98/35840

PCT Pub. Date: Aug. 20, 1998

(30) Foreign Application Priority Data

Feb. 17, 1997 (GB) ..... 97301012
Jul. 28, 1997 (GB) ..... 97305655

(51) Int. Cl.[7] ..... B44C 1/17; B41M 5/00

(52) U.S. Cl. ..... 428/195; 428/143; 428/147; 428/346; 428/914

(58) Field of Search ..... 428/914, 195, 428/346, 349, 143, 147

(56) References Cited

U.S. PATENT DOCUMENTS 5,271,990 A * 12/1993 Kronzer et al. ..... 428/195
5,372,987 A * 12/1994 Fisch et al. ..... 503/227
5,427,840 A * 6/1995 Imamura et al. ..... 428/195
5,501,902 A * 3/1996 Kronzer ..... 428/323
5,948,511 A * 9/1999 Imamura et al. ..... 428/195

FOREIGN PATENT DOCUMENTS

| | | | |
|---|---|---|---|
| EP | 414 135 A2 | * | 2/1991 |
| EP | 588 716 A2 | * | 3/1994 |
| EP | 657 309 A1 | * | 6/1995 |
| GB | 2101932 A | * | 1/1983 |
| GB | 2153833 A | * | 8/1985 |
| WO | WO 96/03285 | * | 2/1996 |

OTHER PUBLICATIONS

Jap Patent Abst 62271777; Canon Inc. "Transfer Sheet Paper", Nov. 1987.*

* cited by examiner

*Primary Examiner*—Daniel Zirker
(74) *Attorney, Agent, or Firm*—Alix, Yale & Ristas, LLP

(57) ABSTRACT

A transfer film (14) for transferring an ink comprising at least one liquid component. The film comprises a heat-activatable adhesive and an ink absorber, and may be mounted on a carrier film (12). The heat-activatable adhesive is in the form of a porous matrix bound together by the ink absorber. When an image is printed on the film, the film will absorb ink from the printer without spreading and blurring of the image. The surface of the film is then placed on the article (20) on which the image is to be transferred and heat applied. The activated adhesive then binds the film (14) to the article (20).

32 Claims, 1 Drawing Sheet

TRANSFER FILM

This invention relates to an ink-printable transfer film on which an image may be printed.

Transfer materials have been available for many years and typically consist of a polymeric or wax film which is supported on a carrier sheet. An image is printed on the film before the film is transferred from the carrier sheet to a substrate usually by applying pressure or heat to the back of the carrier sheet.

In French patent application published as FR 2 715 607, a method is described for decorating an substrate with an image which has first been printed on a transfer material. A digital image from a conventional video camera is printed using an ink jet printer onto the transfer material which comprises a plastic support and a heat-sensitive adhesive coating onto which the ink is printed. The printed side of the transfer material is placed in contact with the substrate and heat applied to activate the support. The plastic support can be removed once the adhesion between the coating and the substrate is greater than that between the coating and the plastic support.

FR 2 715 607 does not disclose the composition of the coating which accepts the printing ink. However, known heat-sealable coatings are essentially continuous films deposited from a polymer solution in organic solvent or water, or from a dispersion of polymer in water with emulsifiers.

There are particular problems associated with using ink jet or bubble jet printers to print images on transfer films. The inks of jet printers are solutions of dyes in solvent which, in use, are sprayed through nozzles onto the surface to be printed. In industrial jet printers, volatile organic solvents are employed and quick drying of the ink is achieved by evaporation of the solvent. However, with desktop jet printers, non-volatile solvents such as water and glycol mixtures must be used to avoid premature drying of the ink and clogging of the spray nozzles. With non-volatile solvents, the ink is held by absorption into the substrate instead of evaporation. The non-volatile solvents work well with absorbent substrates such as paper, but tend to sit on the surface of non-porous substrates such as the known heat-sealable coatings. With certain filmic substrates, such as overhead projection transparencies, it is possible to overcome the absorbency problem by coating the film with water soluble or water-swellable polymers prior to printing. However, these polymers are not sufficiently thermoplastic to be transferable by heat to another substrate, nor are they sufficiently waterproof to produce permanent graphics.

According to the present invention, there is provided a transfer film for transferring an ink comprising at least one liquid component, the film comprising a porous matrix of particles of a heat activatable adhesive bound together by an absorber, the absorber being at least partly soluble in the said liquid component within the porous matrix, and the absorber preferably being within the pores of the matrix.

Preferably the porous matrix of adhesive particles is carried by a carrier film.

Although the film is described as comprising a matrix of particles of adhesive with an absorber within the matrix, it will be appreciated that in isolation the structure could also be described as comprising particles of adhesive within a matrix formed by the absorber. The absorber has the double function of binding the matrix of heat activatable adhesive and at least partially absorbing the liquid component of the ink.

The transfer material can be used with inks that comprise a pigment or mixture of pigments and a liquid component that acts as a vehicle for the pigment. Examples of vehicular components are non volatile solvents such as water and glycol. The absorber should be at least partially soluble in the vehicle of the ink with which the transfer film is to be used. The absorber component is at least partially dissolved by the vehicular component of the ink and on application of the ink a viscous solution of absorber and vehicular component is formed. The viscous solution holds the ink pigment preventing spreading of the ink and blurring of the transferred image formed by the ink.

Preferably the absorber forms a viscous solution of viscosity at least 1500 cp preferably at least 1800 cp, when partially dissolved in the ink vehicle.

Here, the term non-volatile solvent is used to describe the vehicular component of the ink but is not meant to imply that the solvent does not evaporate at all when the ink is incorporated on to the surface of the substrate. In the case of components such as glycol and water "non-volatile" implies that the retention of the dye component of the ink on the substrate is primarily by absorption of the solvent into the substrate and subsequent deposition of the dye component on to the substrate. This is in contrast to other types of ink where the dye is deposited onto the substrate by evaporation of a volatile solvent.

The matrix of particles of adhesive has a porous structure into which ink can be drawn by capillary action. The film thus provides an absorption surface for the vehicular components used in inks and overcomes the tendency of the ink to form droplets on the film surface. Such droplet formation will result in the ink drying on the surface of the film with consequent reduction of the surface tack required to transfer the film to the chosen substrate; this problem is avoided by transfer films according to the present invention.

The absorber also functions as a binder. This results in the transfer forming an almost continuous layer of ink receiving material. A printed image may be applied to the transfer sheet and absorbed by substantially the whole surface area of the transfer sheet, with only very small particles of heat activatable adhesive being present in the surface layer. The small heat activatable adhesive particle size (for example a particle of heat activatable adhesive may have a diameter of between 0.08 and 3 microns, for example 0.1 micron) means that the heat activatable adhesive will have a minimal effect on the resolution of the printed image. Thus transfer films according to the invention give rise to very high resolution images comparable in quality to images produced on the best photographic quality inkjet media currently available.

Preferably the absorber is a heat softenable material.

Preferably, the absorber is a water soluble or hydrophilic organic polymer and the transfer film is used with an ink that contains water as a vehicular component. The inclusion of a water-soluble absorber within the porous matrix of the transfer film moderates the porosity of the film, reducing the spread of ink in the film, and increases overall strength. The water-soluble absorber component holds the ink by interacting with the non volatile ink components (for example water or glycol) and hence allows high definition images to be printed by preventing ink drawn into the film by capillary action from migrating noticeably beyond the point of initial contact.

Preferably the water soluble absorber is acrylate copolymer, cellulose ether, polyvinyl pyrollidone or a combination of two or more of these.

Preferably the ink printable transfer film is supported on a carrier. Preferably the absorber binds the transfer film to the carrier.

Preferably the carrier is a resin coated paper or polymer film, for example polyethylene coated paper, or polyester or polypropylene film. The choice of carrier depends on the surface finish desired.

Preferably the transfer further comprises a wetting agent.

Preferably, the transfer material further comprises an alkaline component such as sodium hydroxide or ammonia solution that stabilizes the transfer material formulation when it is being made and applied to the carrier.

The heat activatable adhesive in the ink printable transfer film has a heat activation temperature also known as the film formation temperature.

In one embodiment of the invention, the ratio of absorber to heat activatable adhesive is chosen so that when the film is placed in contact with a substrate and heated the heat activatable adhesive may form a layer over only a part of the surface of the transfer film. Preferably, the ratio of absorber to heat activatable adhesive is above 1:5 (i.e. greater than 0.2). Preferably, the ratio of absorber to heat activatable adhesive is 1:1.5 (i.e. 2 to 3, or 0.67).

In another embodiment of the invention, the ratio of absorber to heat activatable adhesive is chosen so that when the film is placed in contact with a substrate and heated the heat activatable adhesive forms a layer of adhesive over substantially the whole surface of the transfer film. The transfer film is thus attached to a substrate over substantially the whole surface of the transfer film. Preferably, the ratio of absorber to heat activatable adhesive is 1:9.4.

Preferably the absorber is a softenable absorber to allow greater interaction between the adhesive of the transfer film and the substrate.

Preferably, the heat-activatable adhesive is selected such that the minimum film forming temperature of the transfer sheet is in excess of about 20 degrees C above a typical ambient workshop temperature. More preferably, the heat-activatable adhesive is selected such that the minimum film forming temperature is below about 125° C. More preferably the heat-activatable adhesive is selected such that the minimum film forming temperature is below about 75° C. Preferably, the film of heat activatable adhesive forms over a temperature interval. Preferably the interval is within the range 750 and 125° C. The particles will not then have a tendency to coalesce when stored in the workshop, but will start to form a continuous film when the adhesive is fully activated, when heat is applied to transfer the coating from the carrier sheet to the chosen substrate.

The transfer film may further comprise a stabilizer such as Tinuvin 213, which will prevent fading of the dye and retard degradation of polymers in the transfer film.

The transfer film may further comprise a thickener, for example a polyacrylate such as Latekoll D. Such thickeners aid in production of the transfer film by thickening the formulation mix so it can be applied more easily to a carrier material.

The transfer material may further comprise a weak acid such as boric acid. Boric acid acidifies the finished transfer material which aids in complexation and absorption of components of printing inks, thereby preventing migration of the ink and increasing resolution of the final image. Boric acid, being a weak acid, will not interfere with the alkaline components of the transfer material sufficiently to prevent stabilization of the transfer formulation when it is being made and applied to a carrier.

Embodiments of the invention will now be described, by way of example, with reference to the accompanying figures in which.

Figure 1:
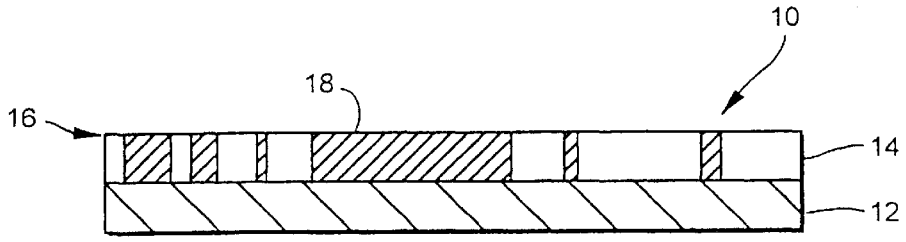
FIG. 1 shows a printed transfer material embodying the invention.
Figure 2:
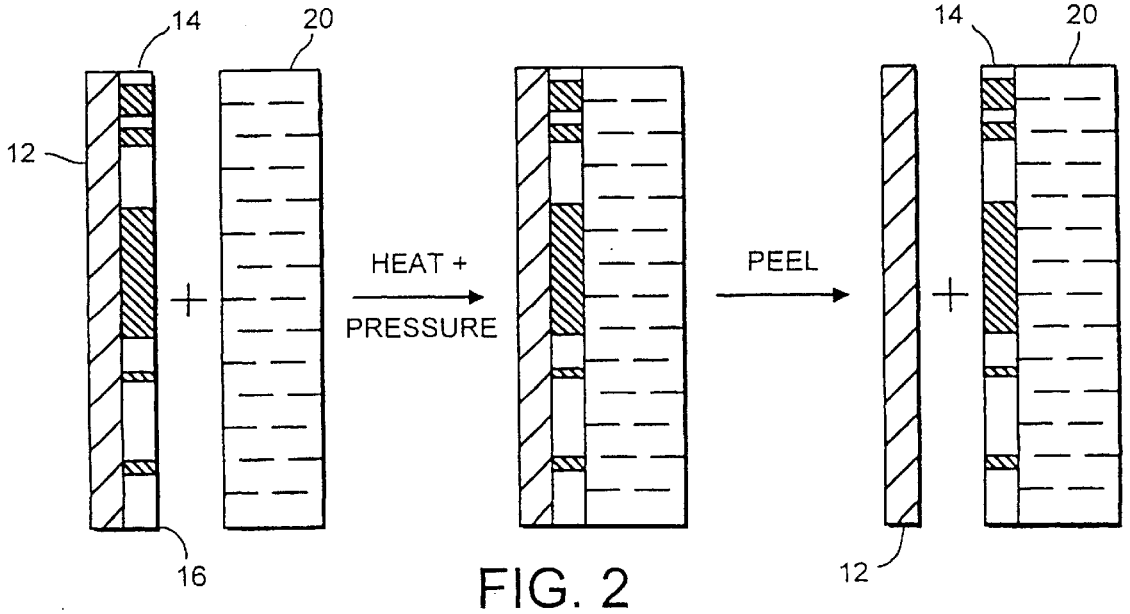
FIG. 2 shows schematically how the printed transfer material of FIG. 1 is used to decorate a substrate.

FIG. 1 shows a sheet of printed transfer material 10, which consists of a carrier sheet 12 and an ink-printable transfer film 14 according to the invention. The transfer film 14 bears an image 18 printed using an ink jet printer (not shown).

The following ink print transfer film formulation 14 was applied to a 50 micron polyester film carrier 12.

| MATERIAL | PERCENTAGE | FUNCTION |
|---|---|---|
| Ucar WBV110 (vinyl copolymer dispersion | 22.81 | Heat activated adhesive |
| Klucel E (hydroxypropyl cellulose) | 7.61 | Heat softenable binder and ink absorber |
| Supronic B75 | 0.38 | Defoamer |
| Lumiten A-FK | 0.74 | Wetting Agent |
| Ammonia, S.G. = 0.880 | 0.40 | Neutraliser for coatability |
| Water | 68.06 | Diluent |
| TOTAL | 100.00 | |

The mixture is made up as a dispersion. When the mixture is applied to the carrier film 12 and dried the heat activatable adhesive forms a matrix within which the absorber is held. The absorber holds the matrix together and aids in adhesion of the mixture to the carrier film.

Neutralizers or pH adjuster such as ammonia are used to make the mixture alkaline and stabilize the adhesive in the mixture formulation. Alternatives to ammonia are potassium hydroxide (aqueous solution), sodium hydroxide, triethanolamine, ethanolamine solution or any water soluble organic base including primary, secondary, tertiary and quaternary amines and polyamines. Lumiten A-FK is a wetting agent. Alternatives include Lumiten I-RA, Lumiten I-AFK, Crodateric CYNA, Atolex ASL/C, Tego Wet KL245 and Surfynol TG.

Supronic B75 acts as a defoamer, alternatives include Supronic E100, Monolan P222 and Pluriol PE6100.

Ucar WBV 110 functions as the heat activatable adhesive. Alternatives include Vinnol Dispersion CE35, Vinnol Dispersion 50, Phenoxy Resin PKHW-35 and Ucar Waterborne Dispersion AW-875.

Klucel 99-E forms the heat softenable binder and ink absorber. Other suitable binders are Glascol LS41, Glascol LS40, Glascol LE15, Glascol DP6-2724, National Adhesives 072-0202, Polyviol MO5/140, Luviskol K30, Collacral VA64, Culminal MC 25S, Blanose Cellulose gum and Natrosol.

The ink printable transfer film 14 is deposited on the carrier sheet 12 by any coating method. Examples of such coating methods are reverse roll, Meyer bar or slot die. The film is dried at a temperature that is not sufficiently high to completely activate the activatable adhesive.

In this embodiment, the heat and pressure activate the adhesive producing a partial layer of resin over the image which seals the image to the substrate. The extent of film formation is dependent on the ratio of adhesive to binder. Where the ratio is such that a partial film is formed on activation, the manufacture of the film is simplified slightly; the dispersion of components may be dried quickly and at high temperature, for example 100 degrees C. Where the ratio is such that a substantially complete film is formed on activation, i.e. with a higher proportion of adhesive, the dispersion must be dried at a temperature below the film forming temperature of the adhesive.

The image is transferred to the carrier film by any printing means, for example transferring the image by an ink jet (or bubblejet) printer. Before the adhesive is activated it comprises discrete particles of adhesive which enable the ink to enter and be absorbed by the absorber in the transfer sheet; the ink is easily absorbed by the sheet as the surface of the transfer sheet is not a single layer of adhesive, while the absorber prevents the ink image from spreading so a high resolution image is maintained on the transfer sheet.

On activation, the adhesive forms a layer (which may be partial or substantially complete) over the transfer sheet which enables the sheet to be fixed to the substrate.

The surface 16 of the printed transfer material placed in contact with the substrate 20 on which the transfer film 14 is to be fixed. Heat and pressure is applied to the carrier sheet 12 using for example a smoothing iron to activate the adhesive and encourage the formation of a bond between the transfer film 14 and substrate 20. The transfer film 14 is then allowed to cool and the carrier sheet 12 peeled away to leave the transfer and image on the substrate 20.

The manufacture of a transfer material according to a further embodiment of the invention is as follows. The following ink print transfer film 14 formulation was applied to a 50 micron polyester film carrier 12.

| MATERIAL | PERCENTAGE | FUNCTION |
|---|---|---|
| Vinnol Dispersion CE35 | 79.5 | Dispersed Phase/Matrix |
| Glascol LS41 | 14.1 | Soluble Absorber |
| Boric Acid | 1.93 | Acidulant/Neutraliser |
| Ammonia Solution, S.G. 0.880 | 1.02 | Neutraliser and Solubiliser |
| Latekoll D | 3.22 | Thickener |
| Lumiten IRA | 0.20 | Wetting Agent |

Vinnol Dispersion CE35. This is a vinyl chloride/vinyl acetate/ethylene copolymer. It is the main heatseal adhesive. Some other suitable reagents are: Vinnol Dispersion 50 (vinyl chloride/vinyl acetate copolymer), Phenoxy Resin PKHW-35 (phenoxy resin dispersion) Ucar Waterborne Dispersion AW-875 (vinyl copolymer, Ucar Waterborne Dispersion WBV 110 (vinyl copolymer) Lutofan 100D (vinyl chloride polymer)and Lutofan LA 451 (vinyl chloride/acrylic ester copolymer).

Glascol LS41. This is a water soluble, anionically-charged, carboxylated acrylic copolymer, sodium salt aqueous solution. It is an absorber (ink vehicle (aqueous fraction) immobilizer). Some other suitable reagents are: Glascol LS40 (as 2 but ammonium salt), Glascol LE15 (higher viscosity version of 2), Glascol DP6-2724 (cationically charged water-soluble polymer, aqueous solution), National Adhesives 072-0202 (unspecified water-soluble polymer), Polyviol MO5/140 (Polyvinyl alcohol), Luviskol K30 (Polyvinyl pyrrolidone), Collacral VA64 (vinyl pyrrolidone/vinyl acetate copolymer), Culminal MC 25S (methyl cellulose), Blanose cellulose gum (sodium carboxymethyl cellulose) Klucel 99-E (hydroxypropyl cellulose) and Natrosol (hydroxyethyl cellulose). Boric acid. The main function of this is to immobilize the glycols and dyes. Some other suitable reagents are: Zirconium Acetate solution, Hydrocol OM2 (Bentonite=modified inorganic pigment), Mystolene ALT (aluminium chloride hydroxide solution) Syloid 244 (silica=silicon dioxide, fine powder), EDTA (ethylene diamine tetra-acetic acid), or salts or complexes, Abscents 3500 (zeolite), Titanium oxide sulphate hydrate, or salts or complexes, Molybdic acid, or salts or complexes and Tungstic acid, or salts or complexes.

Ammonia Solution, S.G. 0.880. Neutralizer and solubilizer. Some other suitable reagents are: Potassium hydroxide, aqueous solution,Triethanolamine, Aqueous Sodium Hydroxide solution, Ethanolamine solution and any water-soluble organic base, including primary, secondary, tertiary and quaternary amines and polyamines.

Latekoll D (polyacrylate dispersion) is used as the main thickener. Some other suitable reagents are: Viscalexes (polyacrylate dispersions), Polyacrylamide and several of the soluble absorbers listed above.

Tinuvin 213 (benzotriazole derivative) is used as a Dye stabilizer. Some other suitable reagents are: Gafsorbs (benzophenone derivatives), Givsorb UV1 (formamidine derivative), Tinuvin 765 (hindered amine light stabilizer) and Irganox 1010 (phenolic antioxidant).

Lumiten I-RA (sodium dialkl sulphosuccinate solution, anionic wetting agent). Some other suitable reagents are: Lumiten I-AFK (salt of sulphonated acid, solution), Crodateric CYNA (amphoteric wetting agent), Atolex ASL/C (cationic wetting agent) plus Lutensol AP6 (alkylphenol ethoxylate nonionic wetting agent) blend, Tego Wet KL245 (ethoxylated silicone nonionic wetting agent) and Surfynol TG (ethoxylated acetylenic diols, nonionic wetting agent).

The mixture is made up as a dispersion in water. When the mixture is applied to the carrier film 12 and dried the heat activatable adhesive forms a matrix which contains the absorber. The absorber holds the matrix together and aids in adhesion of the mixture to the carrier film.

Neutralizers or pH adjusters such as Ammonium hydroxide or Sodium hydroxide are used to make the mixture alkaline and stabilize the adhesive in the mixture formulation. Boric acid is used to acidify the dried coating which results in improved absorption of printer ink and hence reduced ink migration and a higher resolution image. Boric acid is advantageous in that, as it is weak, it does not neutralize $NH_4OH$ or NaOH in the coating process in which alkaline pH is needed.

The ink printable transfer film 14 is deposited on the carrier sheet 12 by any coating method. Examples of such coating methods are reverse roll, Meyer bar or slot die. The film is dried at a temperature that is not sufficiently high to activate the heat activatable adhesive (that is at a temperature below the minimum film forming temperature of the adhesive).

In this example the resulting coating is opaque after deposition on the carrier sheet but the coating becomes transparent when the adhesive is activated by heat.

The surface 16 of the printed transfer material 10 is placed in contact with the substrate 20 which is to receive the transfer film 14. Heat and pressure are applied through the carrier sheet 12 using for example a smoothing iron to activate the adhesive and encourage the formation of a bond between the transfer film 14 and the substrate 20. The transfer film 14 is then allowed to cool and the carrier sheet 12 is peeled away to leave a reversed image on the substrate 20.

The heat and pressure activate the adhesive which clarifies it and produces a layer of resin over the image which seals the image.

In another embodiment of a transfer material according to the invention the carrier sheet is used as a protective laminate to the transferred image. The transfer film and the carrier are not separable when the finished image has been produced. After application of the surface of the transfer material to the substrate, the transfer material is sealed onto the substrate 120 by application of heat and pressure to the carrier sheet. In this embodiment the carrier sheet is a clear film such as polyester or polypropylene film, and provides a further protective coating to the image in the substrate.

It is apparent that the transfer films of the present invention provide a transfer film that can be printed with a high definition image. Additionally transfer films of the present invention have good adhesion to a substrate when applied.

Trademarks and owners are listed below in alphabetical order:

Abscents 3500 is from UOP GmbH, Brkath, Germany

Atolex ASL/C is from Standard Chemical Company, Cheadle, Cheshire, UK

Blanose Cellulose Gum is from Hercules Ltd., Aqualon Division, Salford, Manchester, UK Collacral V A64 is from BASF Aktiengesellschaft, Ludwigshafen, Germany Crodateric CYNA is from Croda Surfactants Ltd., Snaith, Humberside, UK Culminal MC25S is from Hercules Ltd., Aqualon Division, Salford, Manchester, UK Gafsorbs (various grades) are from GAF Europe, Esher, Surrey, UK Givsorb UV1 is from Croxton and Garry, Dorking, Surrey, UK Glascols LS40, LS41, LE15 and DP6-2724 are from Ciba Speciality Chemicals, Bradford, West Yorkshire, UK Hydrocol OM2 is a trademark of Ciba Speciality Chemicals, Bradford, West Yorkshire, UK Irganox 101 0 is from Ciba Chemicals, Manchester, UK Klucel E is from Hercules Ltd., Aqualon Division, Salford, Manchester, UK Latekoll D is from BASF Corp., Cheadle, Cheshire, UK Lumiten A-FK is from BASF Aktiengesellschaft, Ludwigshafen, Germany Lumiten I-AFK is from BASF Aktiengesellschaft, Ludwigshafen, Germany Lumiten I-RA is from BASF Aktiengesellschaft, Ludwigshafen, Germany Lutensol AP6 is from BASF Aktiengesellschaft, Ludwigshafen, Germany Lutofans 100D and LA451 are from BASF Aktiengesellschaft, Ludwigshafen, Germany Luviskol K30 is from BASF Aktiengesellschaft, Ludwigshafen, Germany Monolan P222 is from Harcros Chemicals UK Ltd., Eccles, Manchester, UK Mystolene ALT is from Catomance Ltd., Welwyn Garden City, Hertfordshire, UK National Adhesives 072-0202 is from National Starch and Chemical Co., Slough, Berkshire, UK.

Natrosol is from Hercules Ltd., Aqualon Division, Salford, Manchester, UK

Phenoxy Resin PKHW-35 is from Phenoxy Associates, Rock Hill, S.C., USA

Pluriol PE61 00 is from BASF Aktiengesellschaft, Ludwigshafen, Germany

Polyviol MO5/140 is from Wacker-Chemie, Munich, Germany

Supronic B75 is from ABM Chemicals, Stockport, Cheshire, UK

Supronic E100 is from ABM Chemicals, Stockport, Cheshire, UK

Surfynol TG is from Air Products Nederland BV, Utrecht, The Netherlands

Syloid 244 is from Grace Davison, St. Neots, Cambridgeshire, UK

Tego Wet KL245 is from Tego Chemie, Essen, Germany

Tinuvin 213 and Tinuvin 765 are trademarks of Ciba Chemicals, Manchester, UK.

Ucar Waterborne Dispersions WBV 110 and A W -875 are from Union Carbide Benelux N. V., Antwerp, Belgium Vinnol Dispersions CE35 and 50 are from Wacker-Chemie, Munich, Germany Viscalexes (various grades) are from Allied Colloids, Bradford, Yorkshire, UK.

What is claimed is:

1. A transfer film for transferring an ink comprising at least one liquid component, the film comprising:

a heat-activatable adhesive; and an absorber for absorbing the ink, characterized in that the heat-activatable adhesive is in the form of a porous matrix of particles of heat-activatable adhesive bound together by the absorber and in that the absorber is at least partially soluble in the liquid component of the ink and is within the porous matrix.

2. A transfer material according to claim 1 in which the absorber is heat softenable.

3. A transfer material according to claim 1 in which the adhesive forms on activation a thin layer of adhesive over an area that is substantially the whole surface layer of the transfer film.

4. A transfer material according to claim 1 or in which the proportion of adhesive in the mixture is such that the adhesive forms on activation a thin layer of adhesive over a part area only of the surface layer of the transfer film.

5. A transfer film according to claim 1 wherein the absorber is at least partially water soluble.

6. A transfer film according to claim 1 further comprising at least one of a metal borate salt and boric acid.

7. A transfer film according to claim 1 further comprising a thickening agent.

8. A transfer film according to claim 1 further comprising a dye stabilizer.

9. A transfer film according to claim 1 further comprising a wetting agent.

10. A transfer film according to claim 1 further comprising a defoamer.

11. A transfer film according to claim 1 in which the matrix of heat activatable adhesive comprises particles selected from at least one of a copolymer of vinyl, polyolefin, acrylic polymer, phenoxy resin and polyurethane.

12. A transfer film according to claim 1 wherein the film formation temperature of the porous polymer dispersion of adhesive is between 75 and 125° C.

13. A transfer film according to claim 1 wherein the heat activatable adhesive forms a film over a temperature interval within the range of 75° C. to 125° C.

14. A transfer film according to claim 1 wherein the minimum film temperature of the porous polymer dispersion of adhesive is above the ambient temperature.

15. A transfer material comprising a transfer film according to claim 1 further including a carrier film.

16. A transfer material according to claim 15 wherein the carrier film is clear or transparent.

17. The transfer film of claim 2, in which the adhesive forms on activation a thin layer of adhesive over an area that is substantially the whole surface layer of the transfer film.

18. The transfer film of claim 2, in which the proportion of adhesive in the mixture is such that the adhesive forms on activation a thin layer of adhesive over a part area only of the surface layer of the transfer film.

19. The transfer film of claim 5, in which the absorber is heat softenable.

20. The transfer film of claim 5, in which the adhesive forms on activation a thin layer of adhesive over an area that is substantially the whole surface layer of the transfer film.

21. The transfer film of claim 5, in which the proportion of adhesive in the mixture is such that the adhesive forms on activation a thin layer of adhesive over a part area only of the surface layer of the transfer film.

22. The transfer film of claim 11, in which the absorber is heat softenable.

23. The transfer film of claim 11, in which the adhesive forms on activation a thin layer of adhesive over an area that is substantially the whole surface layer of the transfer film.

24. The transfer film of claim 11, in which the proportion of adhesive in the mixture is such that the adhesive forms on activation a thin layer of adhesive over a part area only of the surface layer of the transfer film.

25. The transfer film of claim 11, wherein the absorber is at least partially water soluble.

26. The transfer film of claim 11, wherein the film formation temperature of the porous polymer dispersion of adhesive is between 75 and 125° C.

27. The transfer film of claim 11, wherein the heat activatable adhesive forms a film over a temperature interval within the range of 75° C. to 125° C.

28. A method of making a heat-sensitive transfer material comprising:

applying a dispersion comprising particles of heat-activatable adhesive and an absorber to a carrier film; and drying the dispersion to form a porous matrix of particles bound together by the absorber within the porous matrix on the carrier film.

29. A method according to claim 28 wherein the dispersion is dried to form a coating at a temperature below the minimum film forming temperature of the heat-activatable adhesive.

30. A method of transferring an ink image to a substrate comprising:

printing an ink image onto a transfer film according to claim 1;

placing the surface of the transfer film on a substrate;

heat activating the heat activatable adhesive thereby causing the transfer film to adhere to the substrate.

31. A method according to claim 30 wherein the transfer film is mounted on a carrier film, further comprising removing the carrier film from the transfer film.

32. A method for laminating an image to a substrate comprising:

printing an ink image onto a transfer film according to claim 16;

placing the surface of the transfer film on a substrate;

heat-activating the heat activatable adhesive thereby causing the transfer film to adhere to the substrate.

* * * * *

UNITED STATES PATENT AND TRADEMARK OFFICE

CERTIFICATE OF CORRECTION

PATENT NO. : 6,346,313 B1
DATED : February 12, 2002
INVENTOR(S) : Cook

It is certified that error appears in the above-identified patent and that said Letters Patent is hereby corrected as shown below:

Title page,
Item [30], after "Feb. 17, 1997" delete "(GB)" and insert -- (EP) --; and after "Jul. 28, 1997" delete "(GB)" and insert -- (EP) --.

Signed and Sealed this

Fourth Day of February, 2003

JAMES E. ROGAN
*Director of the United States Patent and Trademark Office*